United States Patent [19]

Maile et al.

[11] Patent Number: 4,811,031

[45] Date of Patent: Mar. 7, 1989

[54] DBS ANTENNA

[75] Inventors: Graham Maile, Cambridge; Philip Seeney, London, both of England

[73] Assignee: Borg-Warner Chemicals Europe BV, Amsterdam, Netherlands

[21] Appl. No.: 45,367

[22] Filed: May 1, 1987

[30] Foreign Application Priority Data

May 2, 1986 [GB] United Kingdom ..... 8610865
Oct. 31, 1986 [GB] United Kingdom ..... 8626093
Oct. 31, 1986 [GB] United Kingdom ..... 8626080

[51] Int. Cl.[4] ..... H01Q 15/16
[52] U.S. Cl. ..... 343/840
[58] Field of Search ..... 343/781 P, 781 CA, 781 R, 343/840, 878, 880

[56] References Cited

U.S. PATENT DOCUMENTS 3,581,311 5/1971 Kach ..... 343/840
4,527,166 7/1985 Luly ..... 343/840
4,538,175 8/1985 Balses et al. ..... 343/840
4,656,484 4/1987 Brown et al. ..... 343/840

FOREIGN PATENT DOCUMENTS 3308235 9/1984 Fed. Rep. of Germany ..... 343/840
0014506 1/1985 Japan ..... 343/878
0072304 4/1985 Japan ..... 343/840

*Primary Examiner*—William L. Sikes
*Assistant Examiner*—Doris J. Johnson
*Attorney, Agent, or Firm*—Oldham & Oldham Co.

[57] ABSTRACT

A DBS antenna comprises a support arm (10) which at its front end supports a converter/feed unit (12) and at its rear end is secured to a mounting bracket. The antenna dish (14) is mounted on the support arm (10), so that the dish (14) is supported by the arm (10) without mechanical loading from the converter/feed unit (12). The converter feed unit (12) may have a tapering cover portion (74) of sufficient electrical thickness to produce focussing of the signal into the waveguide feed.

13 Claims, 9 Drawing Sheets

DBS ANTENNA

FIELD OF THE INVENTION

This invention relates to an antenna for the reception of direct broadcast satellite (DBS) services.

BACKGROUND TO THE INVENTION

In conventional DBS antennas, the dish is mounted by means of bracketry secured or fixed to the dish itself and the converter and feed are either suspended from extension arms from said bracketry or carried by a tripod or analogous arrangement of legs attached to the rim of the dish. In all such arrangements, the dish directly or indirectly takes the reaction of the mechanical loading of the converter and feed through weight and windage. It is an object of this invention to provide a DBS antenna of improved and simplified construction which can enable reduction in on-site installation time.

THE INVENTION

According to the invention, a DBS antenna comprises an antenna dish, a support arm which at its front end supports a converter and antenna feed unit and at its rear end is adapted for securing to a mounting bracket, the antenna dish being mounted on the support arm at an intermediate position along the length of the arm and being supported by said arm substantially without mechanical loading from the converter and feed unit. In a DBS antenna, the dish is invariably a segment of a parabola with the converter/feed unit located at the focus. In initial designs of DBS antenna and the dish had a diameter of 1 metre or more and in use the converter/-feed unit was located on the axis of the incident transmission. Improvements in the field of electronics lead to the possibility of a dish of reduced diameter, while maintaining the signal/noise ratio of the receiving system. However, reducing the diameter of the dish in a conventional configuration where the converter/feed unit is on the axis of a symmetrical parabolic dish arrangement makes it susceptible to interference from other, unwanted, sources, such as satellites in adjacent orbital slots. This arises because of the increase in the relative sensitivity of the antenna to signals arriving off the axis of the incident wanted transmission. Suppression of these undesirable off-axis sensitivity peak (side lobes) can be achieved by using a non-axisymmetrical section of the parabola where the converter/feed unit does not obstruct the wanted transmission signal incident on the dish.

Such later designs of DBS antennas are generally known as offset antennas, and the present invention is principally concerned with an offset antenna having a dish diameter of the order of 0.6 of a meter.

The invention also extends to the DBS antenna in combination with the mounting bracket for the rear end of the support arm. The support arm may be of circular or cruciform cross-section, for example, and the mounting bracket will be adapted to receive the rear end of the arm, possibly via an adaptor enabling use of the same bracket for differing arm cross-sections.

The mounting bracket will preferably includes parts which enable spatial adjustment of the antenna in both horizontal and vertical planes (elevation and azimuth). Alternatively or additionally, however, the antenna dish may be adjustably mounted to the support arm and be clampable thereto in its adjusted position. The antenna may be pivotably supported relatively to the support arm axis and/or the axis of the parent parabola of which the dish forms part.

Preferably, both the support arm and the dish are made from a polymer suited to high precision moulding. For example, the dish may be moulded of ABS such as "Cycolac" (Trade Mark) and be provided with a metallised front surface, whilst the support may be made of a glass reinforced structural polymer such as "Prevex" (Trade Mark). As is conventional, the main antenna dish may be provided with a cover; this may also be high precision moulded of ABS. When a cover is provided, this may also be mounted to the support arm. The rim of the cover preferably secures to the rim of the main antenna dish, possibly in conjunction with a trapped rim, and in this way may be used to stiffen the main dish in order to enable a lightening of the main dish per se, accompanied by use of a reduced volume of material in manufacture of the latter.

It is important to assist reduction of on-site installation time so that, in addition to production of the dish by high precision moulding techniques, the dish readily secures to the support arm with accuracy of positioning relatively to the converter/feed unit, i.e. the focus point, in order to complete dimensional accuracy of the antenna. To this end, the support arm is preferably manufactured with a shoulder at the correct dimension from the front end focus point where the converter/-feed unit is located, which shoulder serves either for direct location of the dish or indirect location by location of the cover and use of a spacer which locates the dish relative to the cover. When a spacer is employed, this may if desired be integrally formed with the dish or the cover.

The dish may be moulded with a carrying handle on the back and, also on the back, with one or more channels for ducting by means of which the feed, having been taken by means of plug-in ducting from the converter/feed unit at the nose to the rim of the dish, is taken back to the support arm behind the dish. The arrangement of the ducting is such that substantially no additional mechanical loading is imposed on the dish.

At least in part, antenna efficiency is a function of the feed aperture area. If this area is too small, the feed beamwidth is relatively large and signals other than those reflected from the dish, including thermal noise, will be collected and amplified. This so-called "overspill" effect degrades antenna performance. However, subject to this constraint, it is generally desirable to minimise the size of the converter/feed unit, not only to save material and reduce weight, thus reducing the problem of supporting the unit, but also to ensure that the area of the dish is utilised to the best possible extent, giving good so-called "area efficiency".

The present invention may provide a DBS antenna arrangement which makes possible minimisation of the size of the converter/feed unit without introducing an unacceptable overspill effect. This is achieved by arranging the converter/feed unit to be carried at the front end of the support arm, wherein the converter/-feed unit has a cover portion connecting with the support arm through a transition section of a dielectric material, such cover portion being of greater transverse dimensions than the support arm and housing a waveguide feed open at the rear end of the interior of said cover portion towards said transition section, and the said dielectric transition section is a tapering section of sufficient electrical thickness to produce focussing of the signal into the waveguide feed.

In the context of this specification, the term "sufficient electrical thickness" means a material thickness which is substantially greater than the signal wavelength in the material, whereby a focusing action is achieved by refraction of the signal.

In a preferred embodiment, the converter/feed unit cover portion is moulded integrally with the support arm of a plastics dielectric material.

The arrangement is preferably circularly symmetric, so that the "thick" transition section is of conical shape.

The present invention enables reduced dimensions of the converter/feed unit because, due to the focusing action which occurs, there is an apparent increase of waveguide feed diameter over its actual diameter, ie an apparent increase in the feed aperture area which enables avoidance of an unacceptable overspill effect which would otherwise be liable to arise with a feed of this actual diameter.

In general, therefore, the invention enables a reduced size of waveguide feed, and thus of the converter/feed unit, for a given overall antenna efficiency.

Moreover, the same focusing action leads to a shortening of the required focal length for the dish, which is also advantageous both dimensionally and with respect to mechanical loading.

Preferably the DBS antenna includes a converter/-feed unit having a cover portion moulded of plastics material and housing a waveguide feed, wherein the waveguide feed is moulded integrally with the cover portion of plastics material and is provided with a selectively applied metallised coating.

The integral plastics waveguide feed in accordance with the invention reduces the number of separate components to be manufactured, reduces problems of alignment and reduces weight, thus reducing mechanical loading on the means by which the unit is supported.

It is possible, if desired, to integrate passive microwave components such as filters, polarisers and the like, in the interally moulded waveguide feed.

Metallisation for imparting the necessary conductive properties may be applied either to the interior or to the exterior surface of the moulded waveguide feed, primarily according to convenience.

For collecting the signal, the waveguide feed is preferably moulded with a signal-collecting horn open towards the tapering section of the cover portion, at which the focussing action occurs due to signal refraction.

At the front end remote from the signal-collecting horn, the waveguide feed may conveniently be moulded with an interface fitting for interfacing the waveguide feed with a low noise converter (LNC).

DESCRIPTION OF DRAWINGS

Embodiments of the DBS antenna in accordance with the invention are exemplified with reference to the accompanying drawings, in which.

DESCRIPTION OF EMBODIMENTS

Figures 1, 1A:
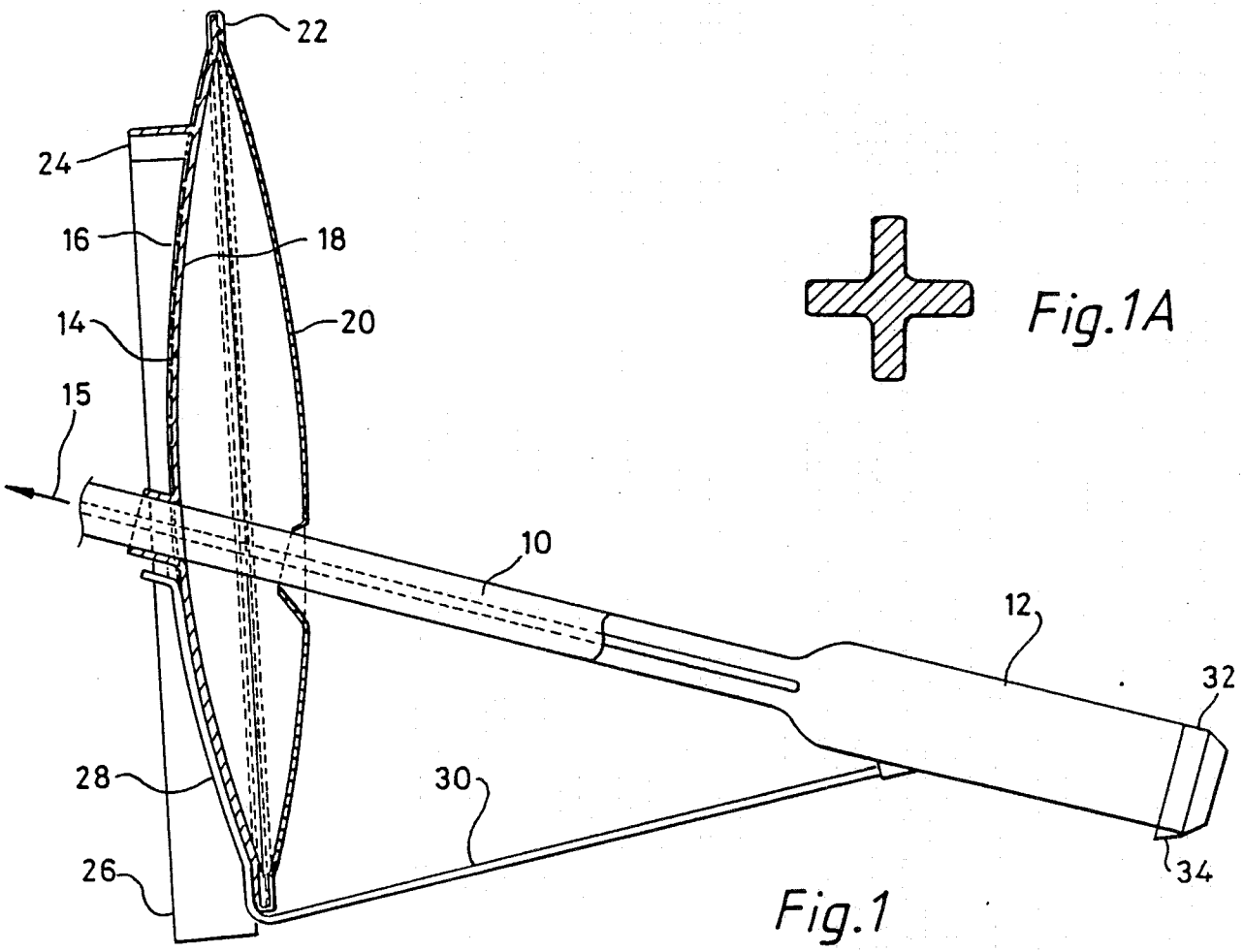
FIG. 1 is a side elevational view of a DBS antenna in accordance with the invention.
FIG. 1A shows the cross-sectional shape of a feed arm of the antenna.

The DBS offset antenna shown in FIG. 1 comprises a support or feed arm 10 carrying a low noise converter (LNC)/feed unit 12 at its front end or nose. An injection moulded main dish 14, stiffened by a grid pattern 16 on its rear surface, is clamped to the feed arm 10 at an intermediate position in the length thereof. Behind the dish 14, the feed arm 10 extends rearwardly, as indicated by arrow 15, to an end adapted to be received in a mounting bracket, such as that shown in and later described with reference to FIG. 2. The feed arm 10 may be of circular cross-section or, as indicated in FIG. 1A, of cruciform cross-section.

A cover moulding 20 is also secured to the feed arm 10. The rim of the cover 20 secures to the rim of the main dish 14 with a trapped extruded trim 22.

The main dish is moulded on the back with an integral carrying handle 24 and a leg 26 by means of which it is stably rested during installation work. The dish is also formed at the back with channels 28 for ducting. A main plug-in ducting tube 30 extends from the converter/feed unit 12 to the rim of the dish, from where the feed is taken back to the feed arm 10 behind the dish.

The converter/feed unit 12 has a removable cap 32 for assisting assembly thereof, and a short leg 34 to improve stability when the antenna is standing during installation work.

The dish 14 is conveniently moulded of ABS and the feed arm 10 of a glass-reinforced structural polymer.

With the illustrated and described construction, it will be noted that the feed arm 10 supports the dish (and optional cover) independently of the converter/feed unit 12 at the nose. When the antenna is mounted, as to a wall, by means of the mounting bracket at the rear end of the feed arm 10, the dish 14 receives substantially no mechanical loading from the converter/feed unit due to weight and windage. The dish, say approximately 0.6 of a meter in diameter, has only to support its own weight. There is no cantilevered weight from the converter/-feed unit.

Dimensional accuracy of the arrangement is essential for good reception. Accordingly, not only is the dish formed by high precision moulding, but also the accurate securing of the dish to the feed arm, in correct spatial relationship to the converter/feed unit, is appropriately facilitated. Three alternative means for locating the dish (and cover) on the feed arm are shown in FIGS. 3 to 5, respectively, as later described.

Figure 2:
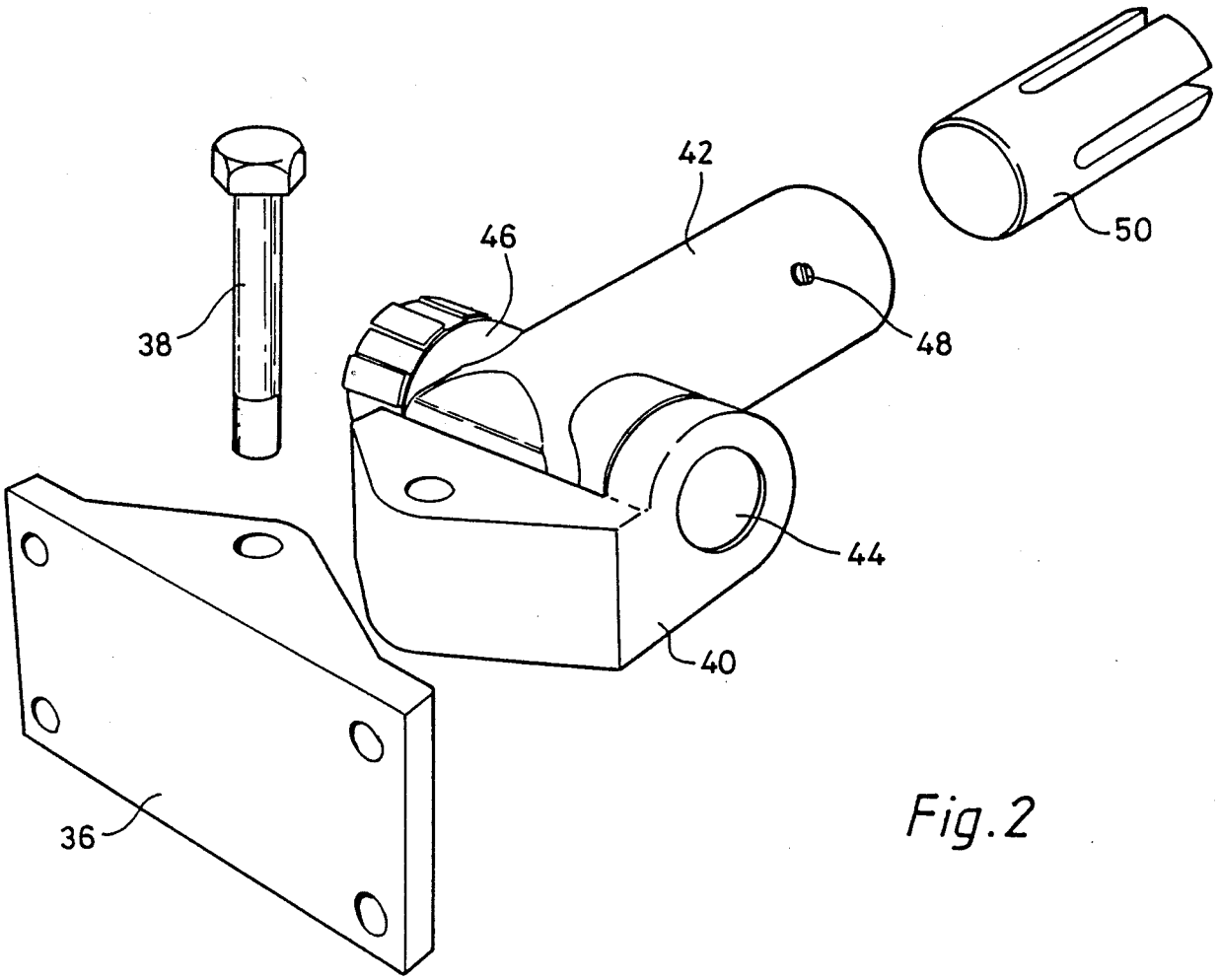
FIG. 2 is an exploded view of a mounting bracket for an antenna.

Referring first to FIG. 2, the mounting bracket, which receives the rear end of the feed arm 10, comprises a wall plate 36 pivotably supporting, by vertical and lockable pivot pin 38, a multi-component part 40, 42 which enables adjustment about horizontal pivot pin 44. Reference 46 denotes friction/locking spacers, whilst reference 48 denotes a locking screw for the rear end of the feed arm. Component 42 may receive a circular sectioned feed arm or, by use of adaptor 50, a feed arm of cruciform cross-section.

Figure 3:
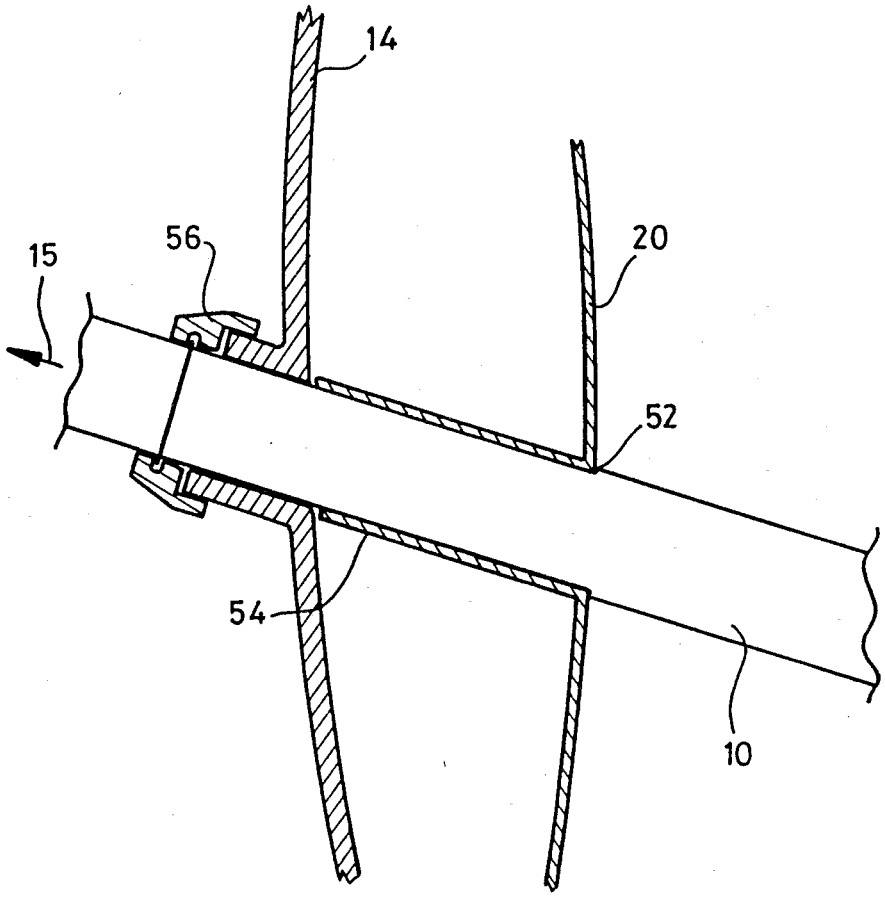
FIGS. 3 to 5 respectively show in diagrammatic manner differing means for securing the dish to the support or feed arm.

FIG. 3 shows one means for securing the main dish 14 to the feed arm 10. A step location 52 is provided for a front cover 20 formed with an integral spacer 54, against the end of which the main dish 14 is located by means of a snap-fit or threaded retention ring 56, which effects distortion free clamping. In the case of a circular sectioned feed arm 10, the dish 14 is suitably keyed or splined to prevent rotation about the feed arm. If desired, the spacer 54 may be formed separately from the cover 20.

Figure 4:
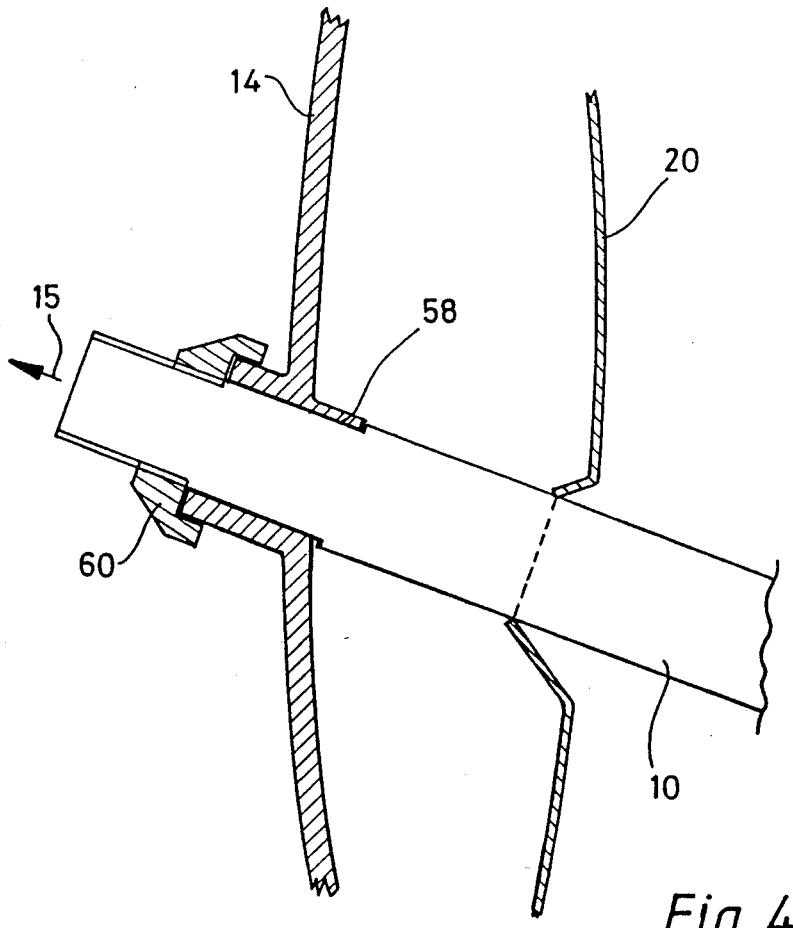
Figure 4A:
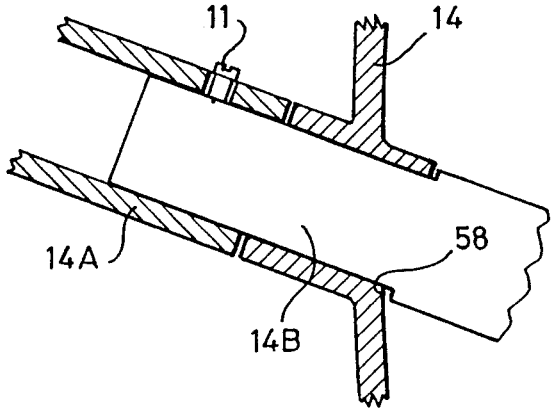
Figure 5:
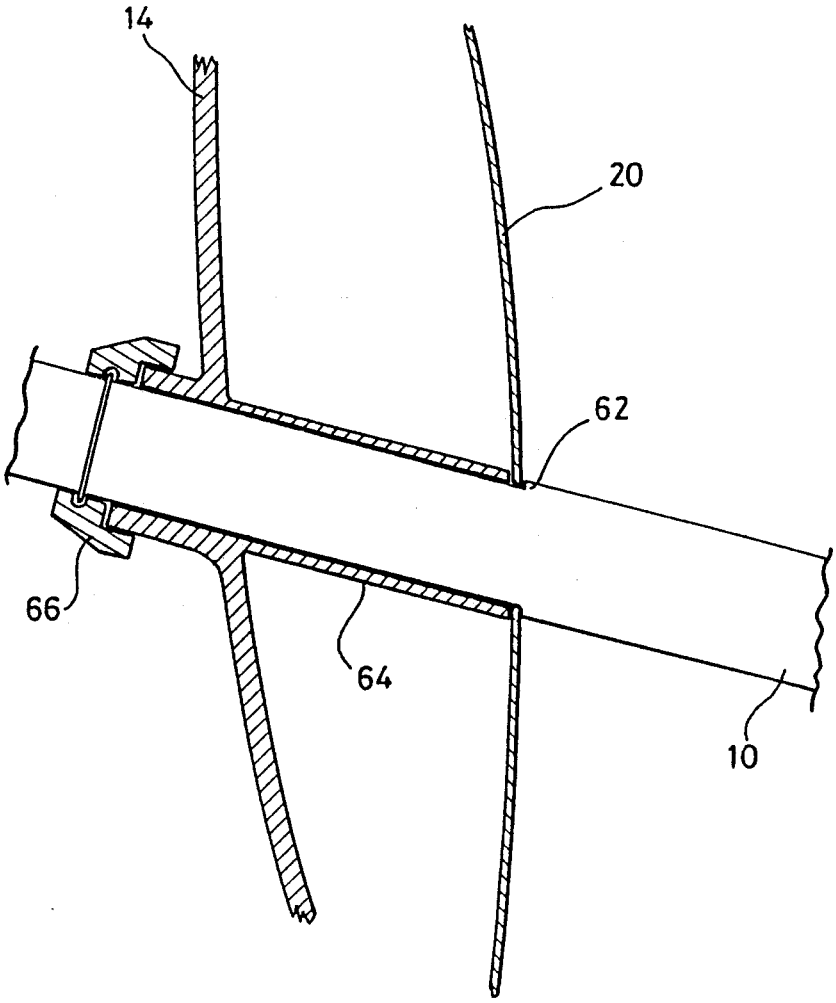

The modified arrangement shown in FIG. 4 utilises a step location 58 for the main dish 14, which is secured against the step by means of a locking ring 60. The cover 20 is independently mounted to the feed arm 10. FIG. 4A shows a further modification using a two part feed arm 10A, 10B and a securing screw 11.

The modified arrangement of FIG. 5 utilises a step location 62 on the feed arm 10 for the cover 20, together with a spacer 64 integrally formed with the main dish 14, which is secured by a locking ring 66.

In all the arrangements, the accuracy of assembly is dependent only on the dimension between the feed arm shoulder and the focus point (converter/feed unit) and, of course, the dimensional accuracy of the dish itself. Both the dish and the feed arm are precision moulded to ensure the required spatial and dimensional accuracy. In practice, the arrangement of FIG. 4 more readily offers greater accuracy of assembly, but, as compared to the arrangements of FIGS. 3 and 5, reduces stiffness contribution from the cover, which is free to move with the load.

Figure 6:
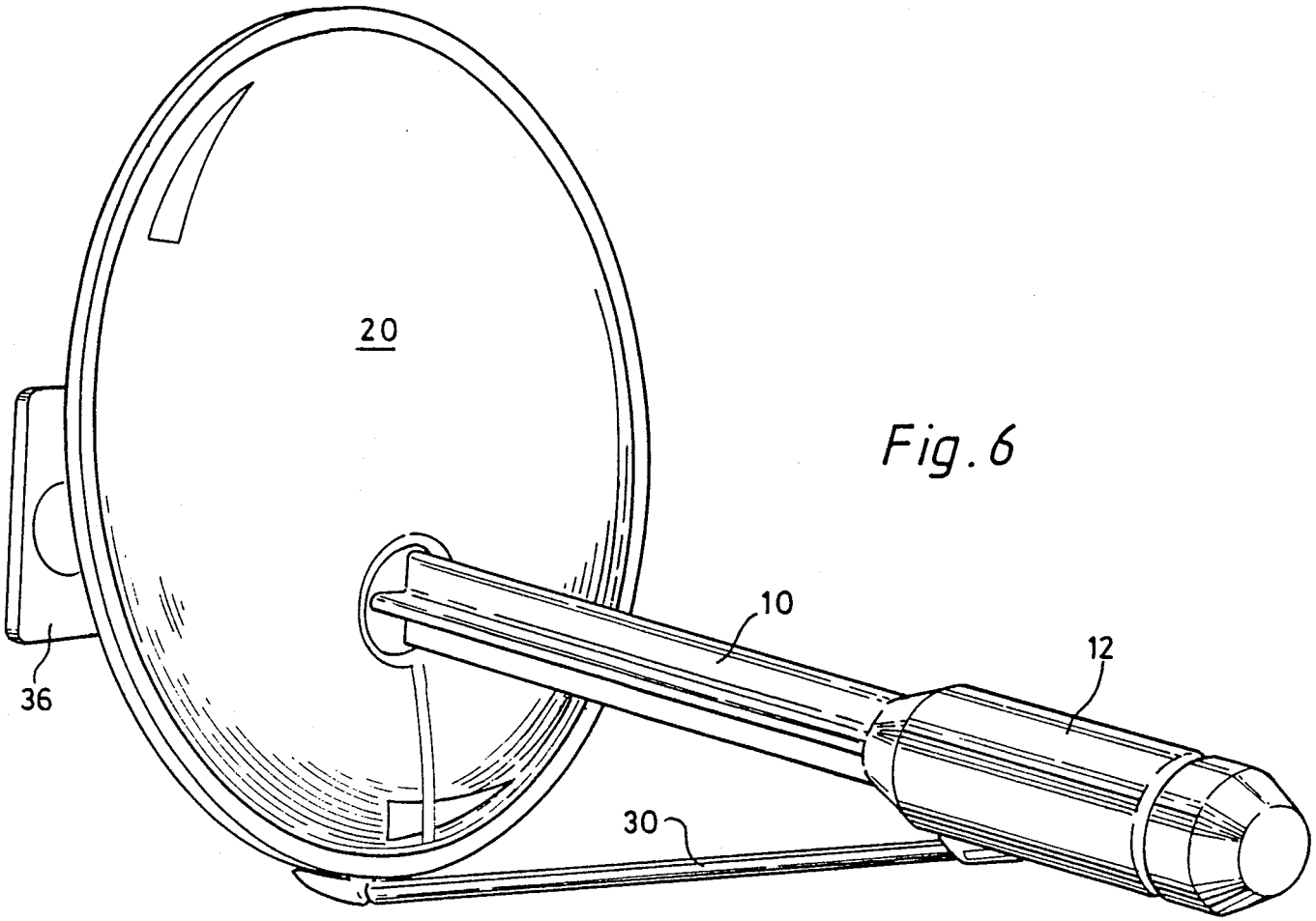
FIG. 6 is a pictorial perspective view of an antenna from the front.
Figure 6A:
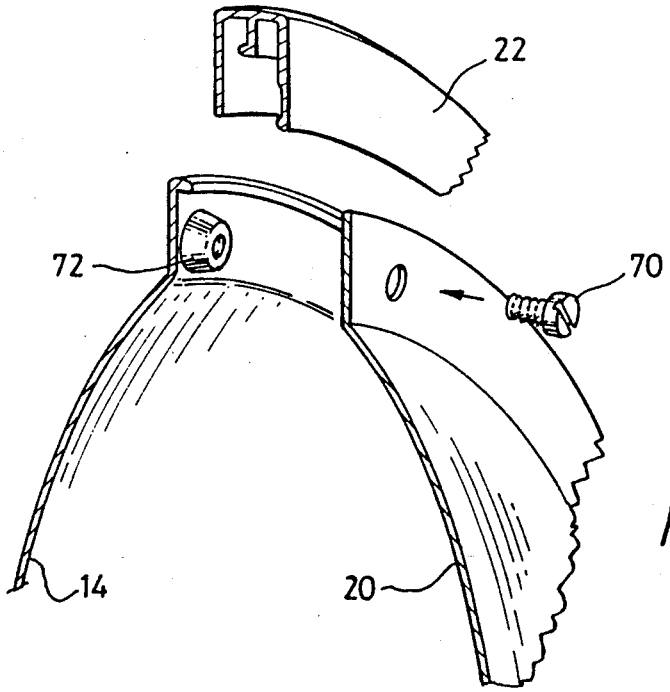
FIGS. 6A and 6B show details of the attachment of a cover to the antenna dish.
Figure 6B:
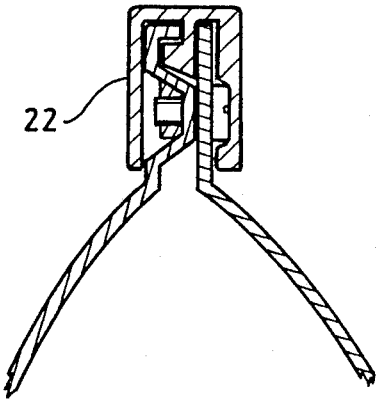
Figure 7:
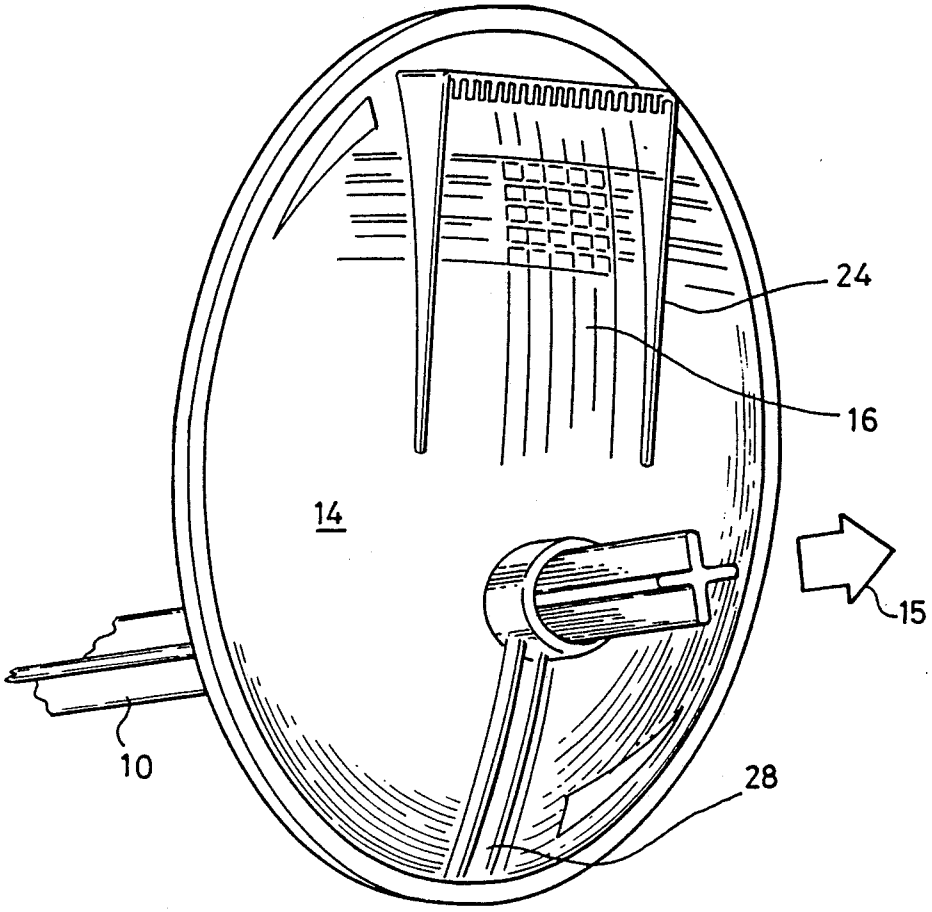
FIG. 7 is a pictorial perspective view of an antenna from the back.

In FIGS. 6 and 7, the same reference numerals are employed as in preceding figures for corresponding parts. FIGS. 6A and 6B show the manner in which the rim of a moulded or vacuum formed cover 20 is secured, by means of securing screws 70 and threaded inserts 72, to the rim of the main dish 14, at the same time securing and trapping the trim 22. The rear perspective view of FIG. 7 shows the integrally formed carrying handle 24 and the channels 28 for ducting, as well as the gridded rib pattern 16 on the rear surface of the main dish.

Various modifications of the aforedescribed and illustrated arrangements are possible within the scope of the defined invention, the essential feature of which resides in a support or feed arm which fixedly or adjustably supports the main dish, with or without a cover, independently of the converter/feed unit at the nose, so that the dish has substantially no mechanical loading other than its own weight, the feed arm being supportable or supported by a mounting bracket at its rear end behind the main dish. In particular, it should be noted that, while in the above-described arrangements the support arm carrying the dish extends physically through the dish surface, this is not an essential requirement. It is practicable for the dish to be mounted to the support arm to one side thereof, as by bracketry, whilst still not imposing any mechanical loading on the dish or the dish bracketry from the converter and feed unit at the front end of the support arm.

Figure 8:
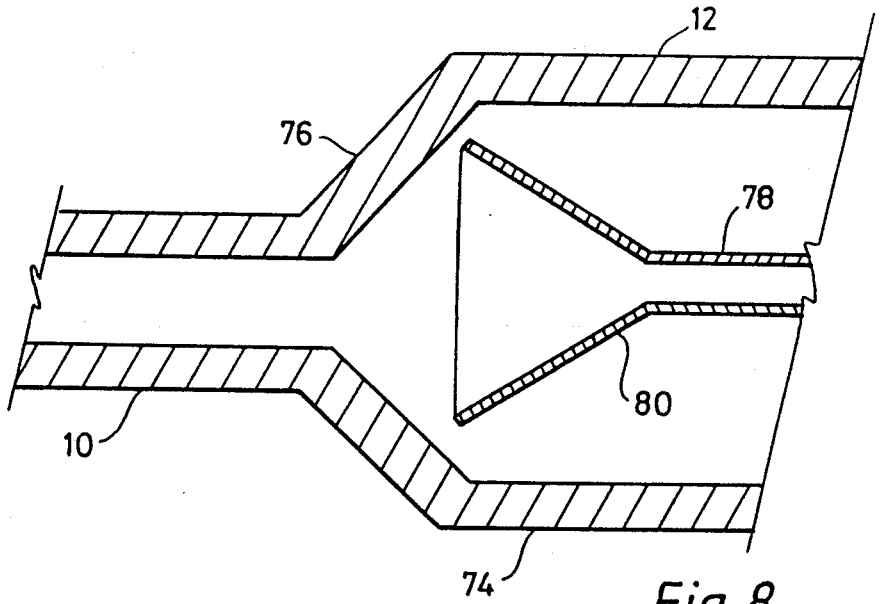
FIG. 8 is an axial cross-sectional view through the supporting feed arm and converter/feed unit.

Referring now to FIG. 8, a part of the feed arm 10 and converter/feed unit 12 are shown, constructed and arranged in accordance with a preferred feature of the present invention.

The unit 12 includes a cover portion 74 which is integrally moulded with the feed arm 10 of a dielectric plastics material. The arrangement is circularly symmetric, and the cover portion 74 connects with the feed arm 10 through a conical transition section 76, since the cover is of greater diameter than the feed arm.

The cover portion 74 houses a waveguide 78 having a signal-collecting horn 80 opening at the rear end of the interior of the cover towards the feed arm 10.

The electrical thickness of the wall of the conical transition section 76 between the cover portion 74 and the feed arm 10 is sufficiently great, in relation to the wavelength of the signal within the material, that signal refraction occurs to produce a focussing action on the signal emanating from the antenna dish 14 (FIG. 1) into the waveguide feed. This results in an apparent increase in the feed aperture area, which enables an unacceptable overspill effect to be avoided with a converter/feed unit of reduced size, and also shortens the required focal length for the antenna dish.

The focussing action in any given construction is readily optimised to maximum advantage, having regard to the particular antenna configuration and the dielectric plastics material concerned.

In a non-optimised general example, a feed beamwidth reduction, and hence apparent feed aperture area increase, of 30 per cent has been observed at a signal frequency of 12GHz.

Figure 9:
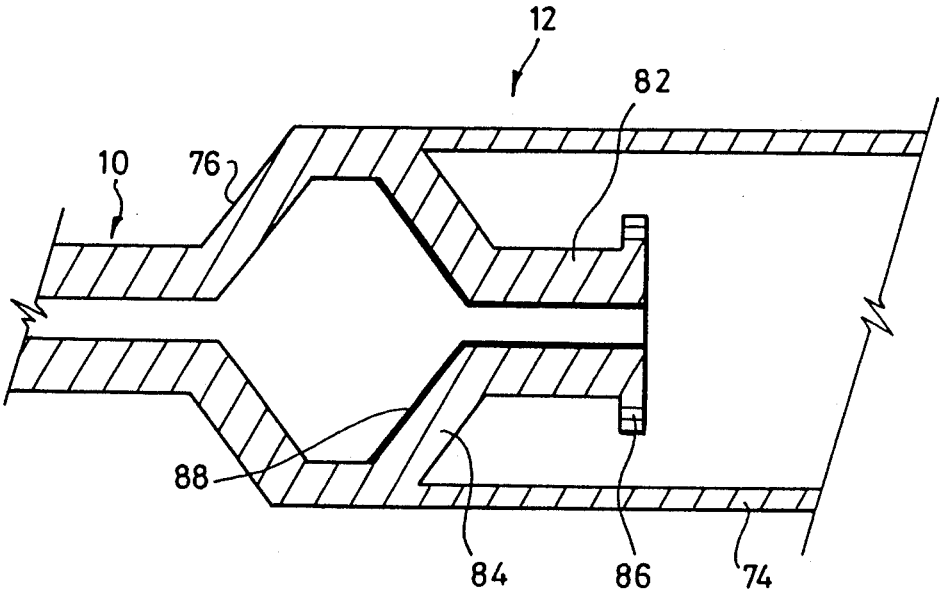
FIG. 9 is an axial cross-sectional view through the supporting feed arm and converter/feed unit.

Referring now to FIG. 9, a part of the feed arm 10 and converter/feed unit 12 are shown, constructed and arranged in accordance with an alternative preferred feature of the present invention.

The unit 12 includes a cover portion 74 which is integrally moulded with the feed arm 10 of a dielectric plastics material. The arrangement is again circularly symmetric, and the cover portion 74 connects with the feed arm 10 through a conical transition section 76, since the cover is of greater diameter than the feed arm.

Moulded integrally with the support arm and cover portion 74 and within said cover, is a waveguide feed 82 having at its rear end a shaped portion forming a signal-collecting horn 84 open towards the conical transition section 76 of the cover. At its front end, the waveguide feed 82 is moulded with an LNC interface fitting 86.

The interior surface of the plastics waveguide feed is provided with a metallised coating 88. Assuming that a plastics antenna dish with metallised coating is employed, it may be convenient to use a common method for metallisation of the dish and selective metallisation of the integrated support arm/cover/waveguide component. Passive microwave components may also be integrated in the moulded waveguide feed 82.

It will be understood that FIG. 9 is of diagrammatic nature only. In practice, moulding will be enabled by a split along a longitudinal plane or by any other convenient method.

We claim:

1. A DBS offset antenna comprising:

a rigid antenna dish molded of plastics materials;

a metallized front surface on said dish;

a rigid support arm molded of plastics material;

a converter and antenna feed unit said unit including a cover portion supporting said unit at the front end of said support arm and said cover portion being molded intergrally with the support arm of a plastics dielectric material;

a mounting bracket including means for attaching the rear end of said support arm thereto; and means mounting the antenna dish to said support arm at an intermediate position along the length of said support arm, in a predetermined spatial relationship to said converter and antenna feed unit located off the axis of the incident transmission, whereby radiation collected by the dish is reflected forwardly by said metallized surface for collection by said off-axis converter and antenna feed unit, and said antenna dish thereby being mounted to said arm substantially without mechanical loading from said converter and antenna feed unit.

2. A DBS antenna according to claim 1, wherein the support arm is of circular cross-section, and the mounting bracket is adapted to receive the rear end of the arm.

3. A DBS antenna according to claim 1, wherein the mounting bracket provides for spatial adjustment of the antenna dish in both horizontal and vertical planes (elevation and azimuth).

4. A DBS antenna according to claim 1, wherein the antenna dish is adjustably mounted on the support arm and is clampable thereto in its adjusted position.

5. A DBS antenna according to claim 1, wherein the antenna dish is provided with a cover mounted on the support arm.

6. A DBS antenna according to claim 1, wherein the support arm has a shoulder to locate the dish with respect to the converter and feed unit.

7. A DBS antenna according to claim 1, wherein the converter/feed unit has a cover portion connecting with the support arm through a transition section of a dielectric material, said cover portion being of greater transverse dimensions than the support arm and housing a waveguide feed open at the rear end of the interior of said cover towards said transition section, and the said dielectric transition section is a tapering section of sufficient electrical thickness to produce focussing of the signal into the waveguide feed.

8. A DBS antenna according to claim 7, wherein the tapering section is circularly symmetric, so that the transition section is of conical shape.

9. A DBS antenna according to claim 1, wherein the converter/feed unit has a cover portion moulded of plastics material and housing a waveguide feed, wherein the waveguide feed is moulded integrally with the cover portion of plastics material and is provided with a selectively applied metallised coating.

10. A DBS antenna according to claim 9, wherein the waveguide feed is moulded with a signal-collecting horn open towards the tapering section of the cover portion, at which the focusing action occurs due to signal refraction.

11. A DBS antenna according to claim 10, wherein at the front end remote from the signal-collecting horn, the waveguide feed is moulded with an interface fitting for interfacing the waveguide feed with a low noise converter (LNC).

12. A DBS antenna according to claim 1, wherein the support arm extends through an aperture in the dish.

13. A DBS antenna according to claim 1, wherein said support arm is of cruciform cross-section, and the mounting bracket is adapted to receive the rear end of said arm.

* * * * *